US008534102B2

(12) United States Patent
Andersson

(10) Patent No.: US 8,534,102 B2
(45) Date of Patent: Sep. 17, 2013

(54) ELECTROMECHANICAL LOCK DEVICE

(75) Inventor: Daniel Andersson, Eskilstuna (SE)

(73) Assignee: ASSA AB, Eskilstuna (SE)

( * ) Notice: Subject to any disclaimer, the term of this patent is extended or adjusted under 35 U.S.C. 154(b) by 900 days.

(21) Appl. No.: 11/912,586

(22) PCT Filed: Apr. 27, 2006

(86) PCT No.: PCT/SE2006/000504
§ 371 (c)(1),
(2), (4) Date: Dec. 17, 2007

(87) PCT Pub. No.: WO2006/118519
PCT Pub. Date: Nov. 9, 2006

(65) Prior Publication Data

US 2008/0141743 A1 Jun. 19, 2008

(30) Foreign Application Priority Data

Apr. 29, 2005 (SE) ..... 0500975

(51) Int. Cl.
*E05B 49/00* (2006.01)

(52) U.S. Cl.
USPC ..... 70/278.7; 70/278.3; 70/283; 70/496

(58) Field of Classification Search
USPC ..... 70/276, 277, 278.1, 278.2, 278.3, 70/278.7, 283, 495, 496
See application file for complete search history.

(56) References Cited

U.S. PATENT DOCUMENTS 4,638,651 A * 1/1987 Surko, Jr. ..... 70/495
4,732,022 A * 3/1988 Oliver ..... 70/406
5,507,162 A * 4/1996 Chhatwal ..... 70/278.3

(Continued)

FOREIGN PATENT DOCUMENTS

EP 1 134 335 A2 9/2001
EP 1134335 A2 9/2001

(Continued)

OTHER PUBLICATIONS

New Zealand Examination Report issue in New Zealand Application No. 563568 dated Dec. 6, 2010 (2 pages).

*Primary Examiner* — Christopher Boswell
(74) *Attorney, Agent, or Firm* — Sughrue Mion, PLLC

(57) ABSTRACT

A lock device comprises a housing (2) which includes an opening (4) and a core (10) which is rotatably disposed in the opening. A latching element (20) co-acts between the housing and the core and can be moved between a release position in which the core is rotatable relative to the housing, and a latching position in which rotation of the core relative to the housing is blocked. An electronically controllable actuator (30) is disposed in the core and is moveable between an opening-registering-position in which the latching element is movable to the release position, and a latching position in which movement of the latching element to said release position is blocked. A returning means (50) co-acts mechanically with a key in a key way in the core and with the actuator and such as to move the actuator away from the position of the opening to a further latching position in response to the key being drawn out of the keyway. Movement of the latching element to said release position is blocked by the actuator in this further latching position. Because the returning means is rotatable there is obtained a small latching mechanism that is returned mechanically to a latching position upon removal of the key.

12 Claims, 7 Drawing Sheets

(56) References Cited

U.S. PATENT DOCUMENTS

| | | | | |
|---|---|---|---|---|
| 5,552,777 | A * | 9/1996 | Gokcebay et al. | 70/278.3 |
| 5,839,307 | A * | 11/1998 | Field et al. | 70/283 |
| 6,318,137 | B1 * | 11/2001 | Chaum | 70/278.3 |
| 6,564,601 | B2 * | 5/2003 | Hyatt Jr. | 70/278.3 |
| 6,615,625 | B2 * | 9/2003 | Davis | 70/278.3 |
| 6,718,806 | B2 * | 4/2004 | Davis | 70/278.3 |
| 7,640,773 | B2 * | 1/2010 | Bellamy et al. | 70/278.3 |
| 7,690,231 | B1 * | 4/2010 | Field et al. | 70/278.3 |
| 2004/0080039 | A1 | 4/2004 | Araya | |
| 2004/0089039 | A1 | 5/2004 | Russell et al. | |

FOREIGN PATENT DOCUMENTS

| | | | |
|---|---|---|---|
| WO | 98/36142 | A1 | 8/1998 |
| WO | 01/48341 | A1 | 7/2001 |
| WO | 0148341 | A1 | 7/2001 |
| WO | 03100199 | A1 | 12/2003 |
| WO | 2004051033 | A1 | 6/2004 |
| WO | 2005001224 | A1 | 1/2005 |

* cited by examiner

ELECTROMECHANICAL LOCK DEVICE

CROSS REFERENCE TO RELATED APPLICATIONS

This application is a National Stage of International Application No. PCT/SE2006/000504 filed on Apr. 27, 2006, claiming priority based on Swedish Patent Application No. 0500975-8, filed Apr. 29, 2005, the contents of all of which are incorporated herein by reference in their entirety.

FIELD OF INVENTION

The present invention relates generally to an electromechanical lock device and then particularly to a lock device in which a latch mechanism is returned mechanically to a latching position by removal of the key.

BACKGROUND OF THE INVENTION

Electromechanical lock devices that include an electrically co-acting or controlled release mechanism for manoeuvring a lock cylinder are known to the art. For example, U.S. Pat. No. 5,839,307 describes an electromechanical cylinder lock that includes outer lock housing and a core which is rotatable in the lock housing and which is controlled by double lock elements, The core includes a plurality of electromechanical lock elements that include slots which receive a side bar in a non-latched position. A magnetic core rotates the electromechanical latching elements to a desired position in relation to the side bar so as to enable the drum to be rotated.

One drawback with this known lock device is that it does not include mechanical resetting of the latch elements. This means that the latch elements will remain in a non-latching state if the lock is activated during manoeuvring of the lock, thereby detracting from the security of the lock. This can be the result if the key-mounted battery that powers the latching mechanism is removed.

A cylinder lock of the kind given in the introduction is described in Swedish patent specification SE 9904771-4. This patent specification describes the manner in which a linearly movable finger (see FIG. 1) rotates an actuator under the control of a key-carried code surface. The actuator, in turn, allows, or prevents, movement of a side bar.

This solution is encumbered with several drawbacks. Firstly, it is relatively space consuming. Secondly, movement of the finger is code-dependent, in other words it is necessary to include a suitable code surface. This solution will not work if the key lacks such a code surface.

The European patent publication EP 1134335A2 describes a lock device of the type given in the introduction, in which a latching mechanism includes a linearly movable part. Consequently, this solution is also space consuming and code dependent.

SUMMARY OF THE PRESENT INVENTION

An object of the present invention is to provide a lock device of the above kind in which the electrically controlled latch mechanism is automatically returned to a latching or blocking state when they key is removed from the lock cylinder, wherewith the latch mechanism is code-independent and occupies but a small space.

The invention is based on the insight that rotary movement of a manoeuvring device in the form of a pivotal pin can be converted to actuator movement.

Accordingly, the invention provides a lock device according to claim 1.

One advantage afforded by the inventive lock device is that the latch mechanism is code-independent since the pivotal or rotatable pin can, in principle, be rotated by any part whatsoever of the key inserted into the lock. Another advantage of the inventive lock device is that the latch mechanism only takes up a small amount of space, since the pivotal pin solely undergoes rotational or pivotal movement.

BRIEF DESCRIPTION OF THE DRAWINGS

The invention will now be described by way of example and with reference to the accompanying drawings, in which.

DETAILED DESCRIPTION OF THE INVENTION

Figure 1:
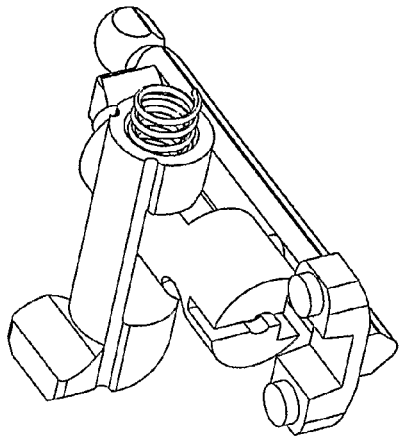
Fig. 1 (Prior art)
FIG. 1 illustrates a latch mechanism of a lock constructed in accordance with known technology.

There follows a detailed description of preferred embodiments of the invention. FIG. 1 illustrates known technology which has already been described in the background section of the present specification and will not be discussed further.

Figure 2:
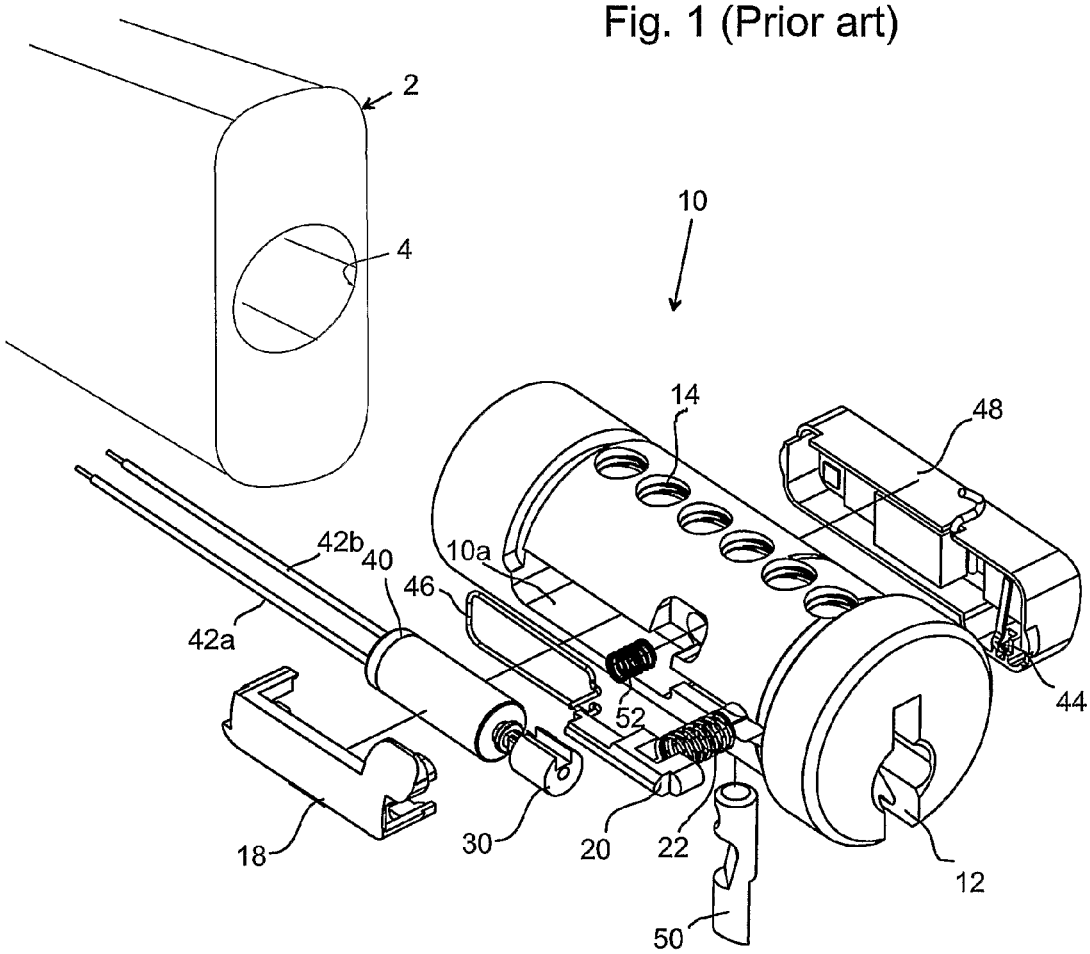
FIG. 2 is a perspective view of a lock device according to the present invention.
Figure 3A:
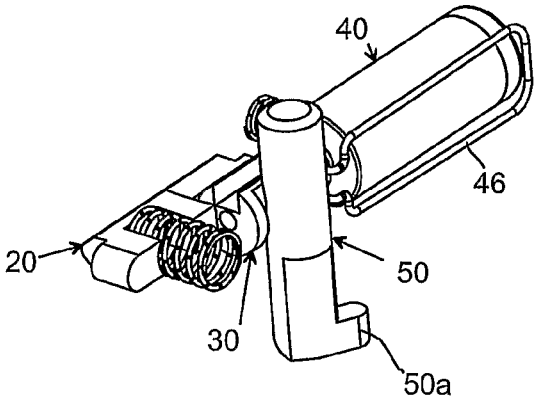
FIGS. 3*a* and 3*b* illustrate in detail a latch mechanism that comprises a side bar, an actuator, a motor and a pivotal pin included in a lock device according to the present invention.
Figure 3B:
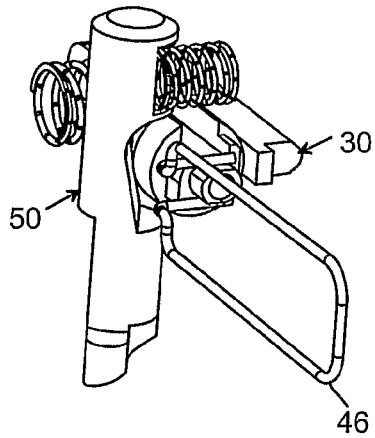
Figure 4A:
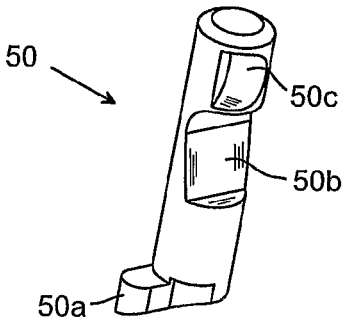
FIGS. 4*a* and 4*b* illustrate in detail the pivotal pin shown in FIGS. 3*a* and 3*b;*
Figure 4B:
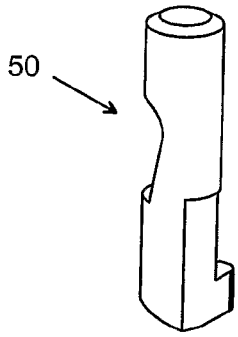

FIG. 2 is an exploded view of a cylinder core, generally referenced 10, in a lock device constructed in accordance with the invention. The core 10 is structured for placement in a circular-cylindrical opening 4 in a typical cylinder house 2 and the core will therefore have an outer surface which corresponds essentially to the house opening. The core includes a key way 12 which is configured to receive a key 60 (shown in FIG. 6*a* for instance) in a typical fashion. The core 10 includes a plurality of pin tumbler openings 14 which receive tumbler pins (not shown) in a typical fashion. The manner in which an appropriately profiled key contacts the tumbler pins and places them on a parting line so that the core 10 can be rotated relative to the lock housing is known in the art and will not therefore will be described here in more detail.

The function or modus operandi of the tumbler pins is ignored throughout the entire description, and it is assumed and an appropriately profiled key has been inserted in the lock. When it is said, for instance, that the core is blocked or latched it is meant that the core is blocked by the electrically controlled latch mechanism.

FIG. 2 also illustrates a side bar 20 which is spring biased radially outwards by a spring 22 acting on the side bar. The side bar blocks rotation of the core 10 relative to the housing 2 when it makes engagement in a cavity 6 in the opening 4; see FIG. 10*a*. The function of the side bar is described in detail in, for instance, Swedish patent application 79067022-4, which is included by reference in the instant application.

The core also includes a generally cylindrical actuator 30 which can be rotated by means of a motor 40. The motor is connected to an electronic module 48 by means of two conductors 42*a*, 42*b*. These conductors are intended to extend in a groove in the barrel surface of the core. In addition to including a custom-made micro-regulating unit with an associated memory for storing and executing software together with drive circuits for driving the motor 40 etc, the electronic module also includes a key contact 44 in the form of an electrically conductive metal strip which is intended to make mechanical contact with a key inserted in the key channel 12. This enables the key and the electronic module to exchange electrical energy and data. Thus, a battery powering the motor 40 and the electronic module 48 can be placed either in the lock device or in the key. A damping spring 46 is provided radially inwards of the motor for damping rotation of the motor 40.

Rotation of the actuator 30 can also be influenced by a pivotal pin 50 which has a rotational axle that extends generally at right angles to the rotational axis of the actuator. The pivotal pin is disposed in a channel 16 that extends up to the key way 12 (see for instance FIG. 6*a*) and parallel with the tumbler pin holes 14. The pivotal pin is spring biased by means of a spring 52 acting on the pin. The function of the pivotal pin spring will be explained below with reference to FIG. 8 and FIGS. 9*a* and 9*b*.

The side bar 20, the actuator 30 and the motor 40 with associated components, such as the damping spring 46, are disposed in a recess 10*a* in the barrel surface of the core and are held in place by a cover 18. Correspondingly, the electronic module 48 is disposed in a recess in the barrel surface of the core opposite the recess 10*a*.

The latch mechanism comprising the side bar 20, the actuator 30, the motor 40 and the pivotal pin 50 winnow be described in detail with reference to FIGS. 3*a*, 3*b* and 5*a*, 5*b*. The pivotal pin 50 includes a peg 50*a* which is intended to co-act with a key inserted in the keyway 12, as explained below. The pivotal pin also includes a recess 50*b* which has a surface that is intended for co-action with the bottom surface of a recess 30*b* on the actuator 30. The pivotal pin also includes a seating 50*c* for the pivotal pin spring 52.

Figure 5A:
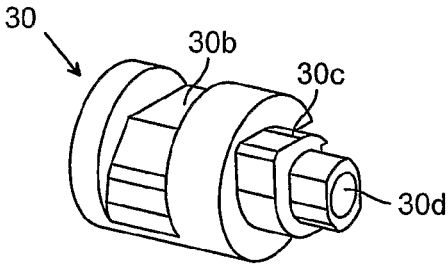
FIGS. 5*a* and 5*b* illustrate in detail the actuator shown in FIGS. 3*a* and 3*b;*
Figure 5B:
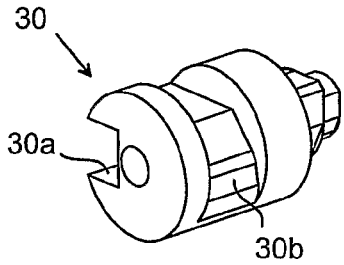

The barrel surface of the actuator 30 is generally cylindrical in shape and includes a longitudinally extending recess 30*a* which is intended to accommodate a part of the side bar 20 when the actuator is located in a release position, as will be explained below. The barrel surface of the actuator also includes a recess 30*b* which extends around the midway portion of the actuator through an angle of about 225 degrees, as shown in FIGS. 5*a* and 5*b*. This recess includes a plurality of planar bottom surfaces which are intended for co-action with the bottom surface of the pivotal pin recess 50*b*, as will be explained below. The actuator 30 also includes a neck portion 30*c* which is intended for co-action with the damping spring 46 such as to dampen excessive movement of the actuator and to render manipulation of the lock by hammering against the lock difficult to achieve. Finally, the actuator also includes an axially extending hole 30*d* for accommodating a shaft of the motor 40.

Figure 6A:
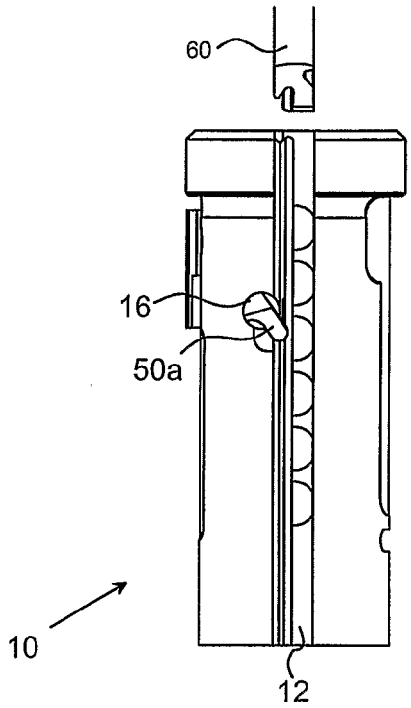
FIGS. 6*a* and 6*b* are views from beneath the core shown in FIG. 2, from which manoeuvring of the pivotal pin is evident.
Figure 6B:
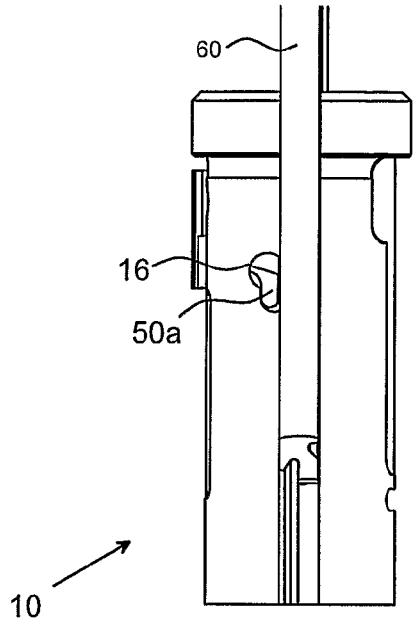
Figure 7B:
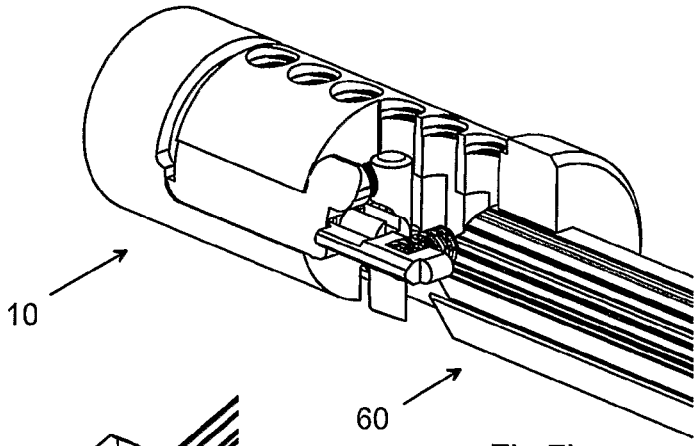
FIGS. 7*a* and 7*b* are partially cut-away perspective views of the cylinder core shown in FIG. 2, the interaction between a key and the pivotal pin being evident from said figures.
Figure 7A:
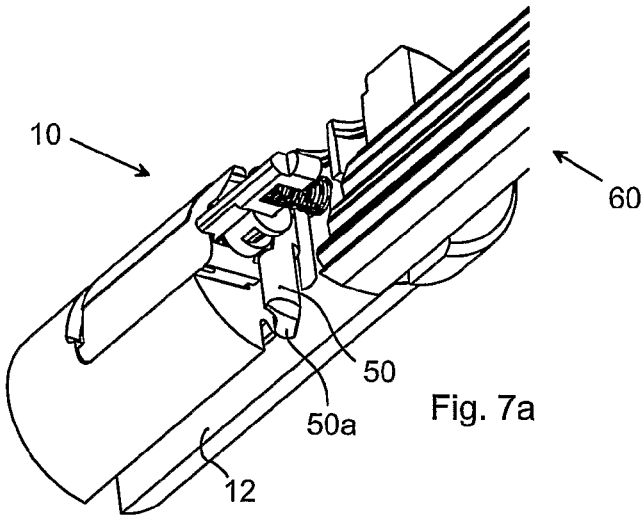

FIG. 6*a* is a view of the core 10 from beneath with no key 60 inserted, which clearly shows the key way 12. FIG. 6*a* also clearly shows that the peg 50*a* of the pivotal pin extends into the key way. As will clearly be seen from FIG. 6*b*, the key inserted in the key way has forced away the peg 50*a* and thereby caused the pivotal pin to rotate or pivot through an angle of about 30 degrees. The interaction between the pivotal pin 50 and the key 60 is clearly evident from the partially cut-away perspective views of FIGS. 7*a* and 7*b*.

Because the key bit acts on a rotatable or pivotal pin, the mechanical solution is, in principle, independent of the design of the key bit. This means that the solution is not code-dependent but can be used, in principle with any type of key, which is highly beneficial.

Figure 8:
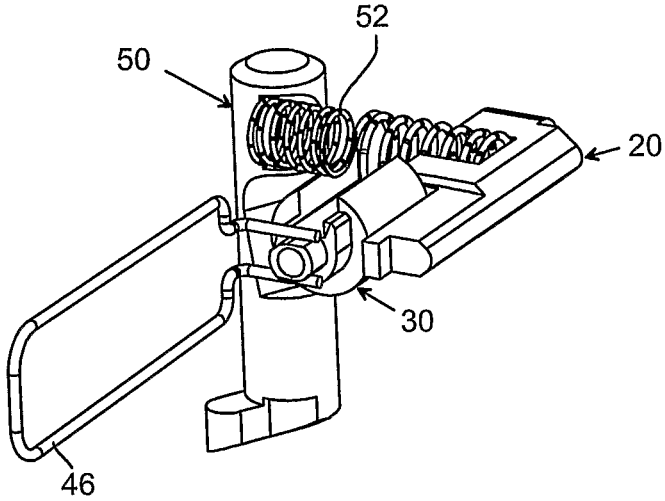
FIG. 8 is a perspective view of the latch mechanism, showing a biasing spring for co-action with the pivotal pin.
Figure 9A:
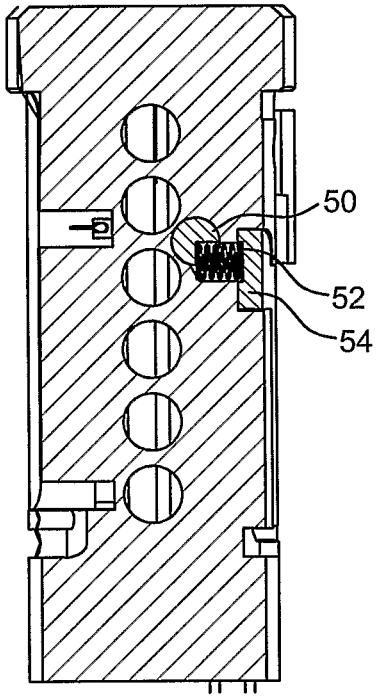
FIGS. 9*a* and 9*b* are sectional views from above that illustrate spring biasing of the pivotal pin.
Figure 9B:
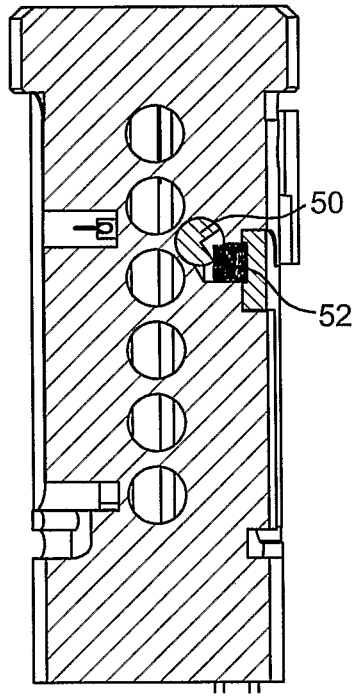

Biasing of the pivotal pin 50 to the position shown in FIG. 6*a* is achieved with the aid of a pivotal pin spring 52, as evident from FIG. 8. This spring is tensioned between a plug 54 (shown in FIG. 9*a*) and the spring seating 50*c* on the pivotal pin and strives to move the pin to the position shown in FIG. 6*a*. FIG. 9*a* is a sectioned view through to the core 10 and shows on a level with the pivotal pin spring an expanded spring 52 which urges the pivotal pin to a starting position. FIG. 9*b* illustrates the instance when an inserted key has rotated the pivotal pin so as to compress the pivotal pin spring. However, the in-built force of the spring 52 strives to return the pivotal pin to the position shown in FIG. 9*a*, which is allowed when the key is removed from the key way 12.

Figure 10A:
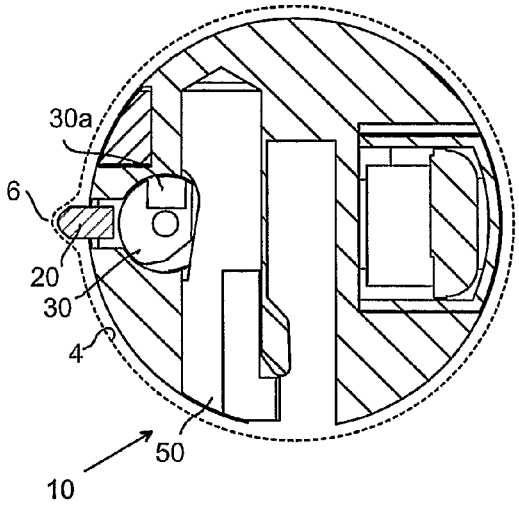
FIGS. 10*a*-10*d* are cross-sectional views of the cylinder core in different stages of the electrical release or restoration of the latch mechanism.
Figure 10B:
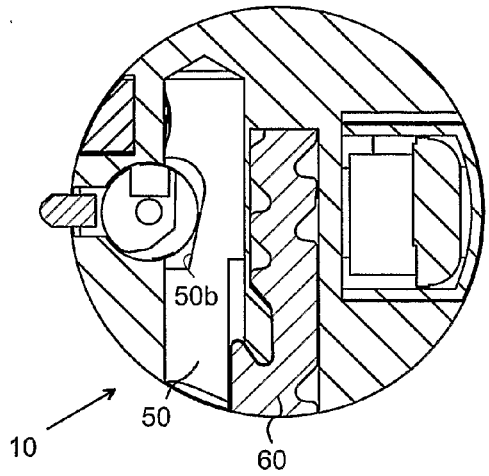

Normal electrical operation of the actuator 30 will be described below with reference to FIGS. 10*a-d*. FIG. 10*a* shows a starting position in which the actuator has been rotated by the motor 40 through about 90 degrees from the release position, in which the recess 30*a* for accommodating the side bar coincides with the side bar 20 and therewith allows the side bar to be received. The recess 50*b* in the pivotal pin 50 allows this position of the actuator to be achieved when no key is inserted in the key way 12. The recesses 30*b* and 50*b* in the actuator and the pivotal pin respectively are thus formed so that the pivotal pin will not influence control of the motor.

As shown in FIG. 10*a*, the side bar is prevented from leaving the cavity 6 in the lock housing and the core is prevented from rotating in the lock housing.

When a key 60 is inserted into the key way, thereby rotating the pivotal pin so that its recess 50*b* faces towards the actuator (see FIG. 10*b*), the actuator is able to rotate through 90 degrees to a release position. This rotation has been completed in FIG. 10*c*, from which it will be seen that the recess 30*a* on the actuator 30 is turned directly towards the side bar 20.

Figure 10C:
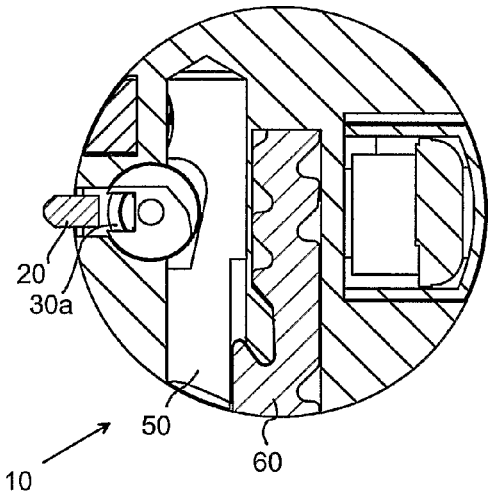
Figure 10D:
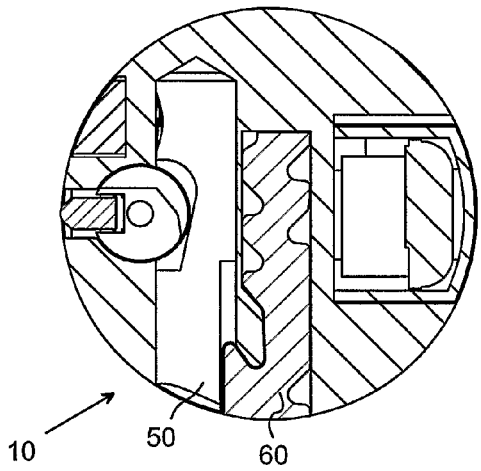

Finally, it will be seen from FIG. 10*d* that the side bar 20 has been pressed into the recess 30*a* of the actuator by rotation of the core 10. This allows rotation of the core 10 in the lock housing 2.

When the key 60 is removed from the core, the motor 40 is controlled electrically such as to rotate the actuator 30 to the latching position shown in FIG. 10*a*. However, should the power supply to the motor be cut-off for some reason or other, or should rotation of the actuator be blocked when the key is withdrawn, the actuator will remain in the release position shown in FIG. 10*d* and thereby lower the security of the lock device. This may be the result of someone removing from the key the battery that powers the electronic module 48 and the motor 40, or as the result of a mains failure in respect of a conductor-powered lock. In such cases the latch mechanism of the inventive lock device functions to return the actuator mechanically to a latching position, as will now be described with reference to FIGS. 11*a-f*.

Figure 11A:
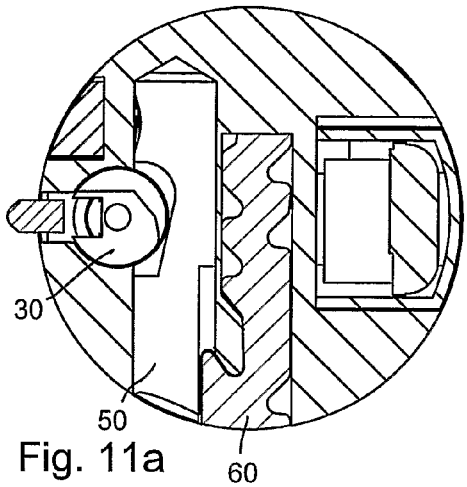
FIGS. 11*a*-11*f* are cross-sectional views corresponding to those shown in FIGS. 6*a*-6*d*, although showing different stages of a mechanical release of the latch mechanism.
Figure 11B:
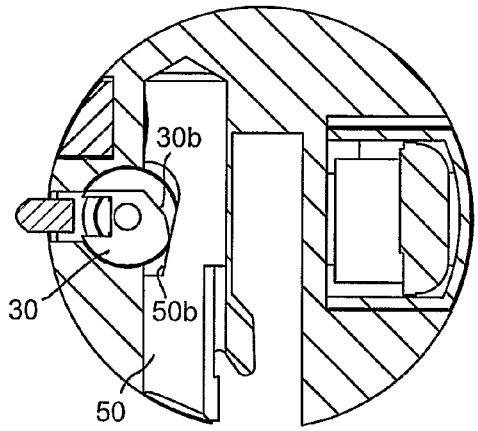
Figure 11C:
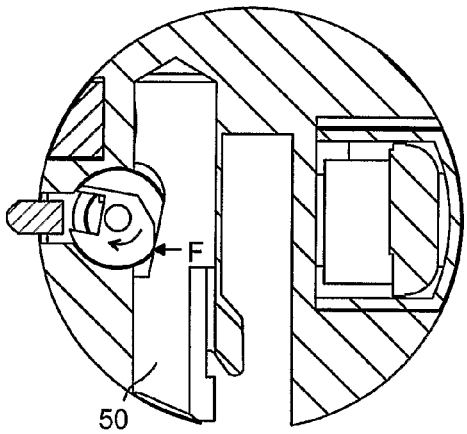

FIG. 11*a* shows a starting position for removal of the key 60 corresponding to the position shown in FIG. 10*c*. As will be evident from FIG. 11*b*, as the key is removed the pivotal pin 50 begins to rotate to its starting position, see for instance FIG. 6*a*. The bottom surface of the pivotal pin recess 50*b* is therewith brought into contact with the bottom surface of the actuator recess 30*b*. In turn, this applies a force F to the actuator below its axis of rotation, as shown in FIG. 11*c*. The actuator is therewith caused to rotate such as to turn the actuator from the release position shown in FIG. 11*a*.

Figure 11D:
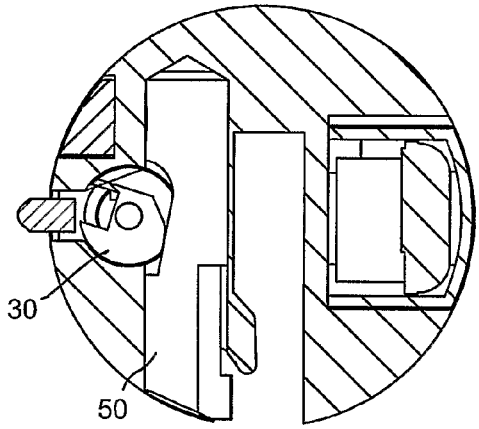
Figure 11E:
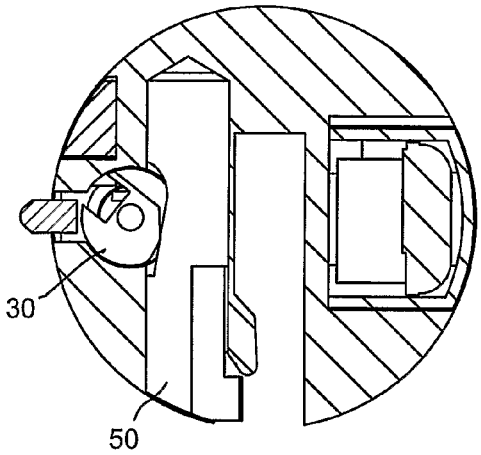
Figure 11F:
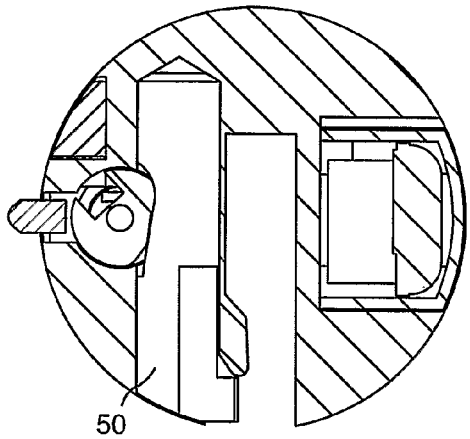

Rotation of the pivotal pin 50 and therewith rotation of the actuator 30, continues until the pivotal pin has reached its starting position, see FIGS. 11*d* and 11*e*. In this position, the actuator has rotated from its release position through an angle of about 50 degrees; see FIG. 11*f*.

The combination of a rotatable or pivotal pin and a rotatable actuator for mechanical return of the latch mechanism that is controlled electrically in normal operation provides a code-independent solution that takes up only a small amount of space in the core.

Figure 12:
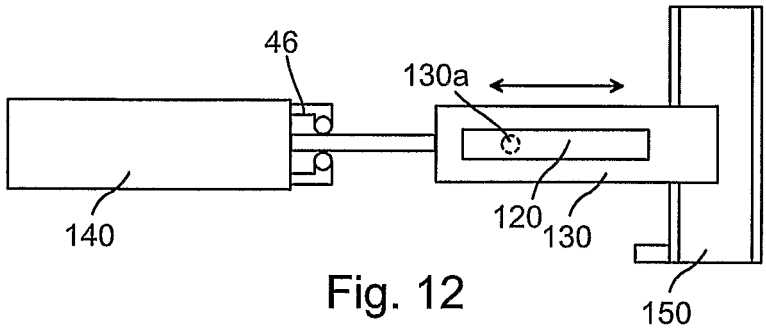
FIG. 12 is a side view of the latch mechanism in the case of an alternative embodiment of the invention.
Figure 13A:
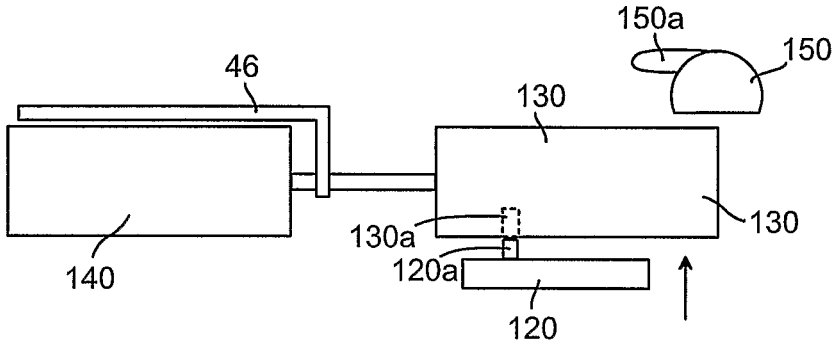
FIGS. 13*a*-13*c* are plan views of the latch mechanism shown in FIG. 12 in different latching or blocking states.
Figure 13B:
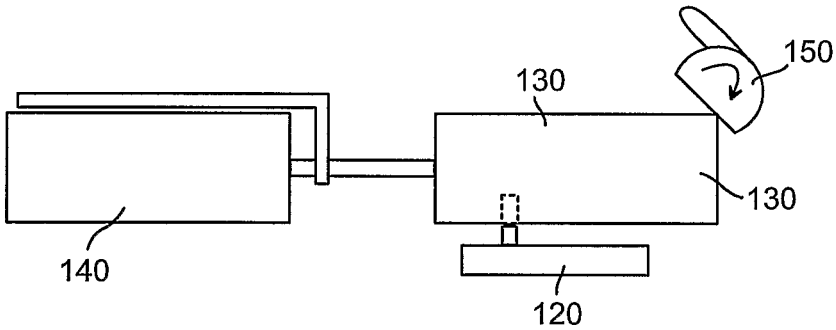
Figure 13C:
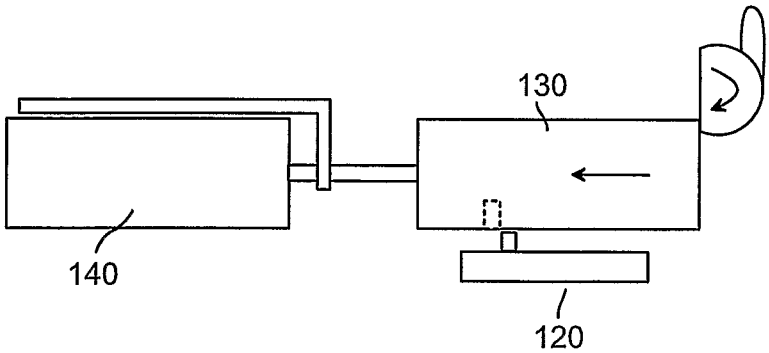

In the case of an alternative embodiment shown in FIG. 12 and in FIGS. 13*a-c* the motor 40 with its rotatable shaft has been replaced with a linearly active motor or solenoid 140. This linear motor or solenoid is connected to an actuator 130 which is movable in a longitudinal direction. The actuator includes a hole 130*a* which is intended to receive a peg 120*a* on a side bar 120. In the position shown in FIG. 13*a* the side bar can be moved towards the actuator, since the peg is in alignment with the hole 130*a*.

A damping spring 146 corresponding to the earlier described spring 46 lies against the shaft that connects motor and actuator.

A pivotal pin 150 corresponding to the pivotal pin of the first embodiment is adapted to be moved mechanically by the actuator when removing the key from the lock device. The pin 150 thus includes a peg 150*a* or some other element that can be actuated by means of a key inserted into the lock device. The pin 150 is also spring biased with the aid of a spring (not shown). As will be evident from FIG. 13*b*, as the pivotal pin is rotated a surface on the pin presses against the end surface of the actuator, therewith causing the actuator to move linearly in a direction towards the motor; see FIG. 13*c*. The hole 130*a* is therewith moved out of alignment with the peg 120*a* on the side bar and the side bar is therewith prevented from moving inwardly towards the actuator. The actuator 130 thereby has the same function as the rotatable actuator 30 in the embodiment first described.

Although a lock device according to the present invention has been described with reference to preferred embodiments thereof, a person of average skill in this art will be aware that modifications and variations can be made within the scope of the accompanying claims. For example, although there has been described a motor which is powered by a battery situated in the key, it will be understood that the motor may be powered by a battery situated in the lock or by an external power source that is connected to the lock by means of electrical conductors.

The actuator has been described and illustrated in a specific form. It will be understood, however, that the actuator may have any desired form provided that it can be moved from a released position (FIGS. 11*a*, 13*a*) to a latching position (FIGS. 11*f*, 13*c*) through the agency of a mechanical control as the key is withdrawn from the lock.

Although only one pivotal pin has been shown in the figures, it will be understood that the lock device may include more than one pin that co-operate with an inserted key and the actuator.

The electrical manoeuvring of the actuator 30 to its latching position has been described as rotational movement through 90 degrees. It will be understood that this rotation may involve other degrees of movement provided that the recess 30*a* for accommodating the side bar is not located centrally opposite to the side bar. It will also be understood that the same latching position can be utilized with both electrically and mechanically manoeuvred latch mechanisms.

Although a combination of an electrically controlled latch mechanism and conventional pin tumblers has been illustrated it will be understood that the concept of the invention can also be applied to lock devices that lack other latching means than the electronically controlled latch mechanism described above.

The invention claimed is:

1. A lock device comprising:

a housing (2) which includes an opening (4);

a core (10) which is rotatably mounted in the opening (4) and which includes a key way (12) for reception of a key (60);

a latching element (20;120) which co-acts between the housing (2) and the core (10) and which is movable between a release position in which the core is rotatable relative to the housing, and a latching position in which rotation of the core relative to the housing is blocked;

an electronically controllable actuator (30;130) which is mounted in the core (10) and which is movable between an opening-registering position in which movement of the latching element (20;120) to the release position is permitted, and a latching position in which movement of the latching element to said release position is blocked; and a returning means (50;150) which co-acts mechanically with the key and with the actuator and functions to move the actuator from the opening-registering position to a further latching position in response to withdrawal of the key from the key way wherein the further latching position prevents movement of the latching element (20) to said release position, characterized in that the returning means (50; 150) is rotatable and arranged to be rotated by contacting the key as the key is inserted into the key way.

2. The lock device according to claim 1, wherein the returning means (50; 150) includes a rotatable axle which extends generally at right angles to the longitudinal axis of the actuator (30;130).

3. The lock device according to claim 2, wherein the returning means comprises a pivotal pin.

4. The lock device according to claim 1, wherein the returning means (50; 150) is spring biased with the aid of a spring (52) such as to move the actuator towards said further latching position.

5. The lock device according to claim 1, wherein the returning means (50; 150) includes a peg (50*a*, 150*a*) which is intended to co-act with a key (60) inserted into the key way (12).

6. The lock device according to claim 1, wherein the actuator (50) is rotatable.

7. The lock device according to claim 6, wherein the returning means (50) includes a recess (50*b*) that has a surface which is intended for co-action with the bottom surface of a recess (30*b*) on the actuator (30).

8. The lock device according to claim 7, wherein contact between the bottom surface of the recess (50*b*) on the returning means and the bottom surface of the recess (30*b*) on the actuator (30) results in the application of a force (F) on the actuator below its axis of rotation.

9. The lock device according to claim 7, wherein the recess on the actuator extends around the centremost part of the actuator through an angle of generally 225 degrees.

10. The lock device according to claim 7, wherein the recess (30*b*) on the actuator includes a plurality of planar bottom surfaces.

11. The lock device according to claim 1, wherein the actuator (130) is linearly movable.

12. The lock device according to claim 1, wherein the returning means comprises a pivotal pin.

* * * * *